United States Patent [19]

Kronja et al.

[11] Patent Number: 4,968,039

[45] Date of Patent: Nov. 6, 1990

[54] AMUSEMENT GAME APPARATUS

[76] Inventors: Alejandro M. Kronja; Carlos E. Vasile, both of Concepcion Arenal 6551 Mar del Plata, Buenos Aires, Argentina

[21] Appl. No.: 493,661

[22] Filed: Mar. 15, 1990

[30] Foreign Application Priority Data

Mar. 16, 1989 [AR] Argentina ..... 313,424

[51] Int. Cl.[5] ..... A63F 3/00

[52] U.S. Cl. ..... 273/255

[58] Field of Search ..... 273/242, 243, 248, 249, 273/255, 262, 288

[56] References Cited

U.S. PATENT DOCUMENTS 2,313,303 3/1943 Szatrow ..... 273/262
4,200,293 4/1980 Benson, III ..... 273/262 X
4,221,389 9/1980 Read ..... 273/262
4,373,731 2/1983 Whiteman et al. ..... 273/262
4,695,056 9/1987 Cornelson et al. ..... 273/262

*Primary Examiner*—Edward M. Coven
*Assistant Examiner*—William E. Stoll
*Attorney, Agent, or Firm*—Sughrue, Mion, Zinn, MacPeak and Seas

[57] ABSTRACT

A game apparatus includes a board laid out in a number of square sections arranged in rows and columns, each section being marked with horizontal, vertical and diagonal bisecting or symmetry lines. Each player mainpulates one or more tank pieces having rotatable gun turrets in acordance with commands specified on movement cards arranged in a selected sequence by the player. The movement, rotation and firing directions coincide with the symmetry lines.

3 Claims, 3 Drawing Sheets

AMUSEMENT GAME APPARATUS

BACKGROUND OF THE INVENTION

This invention relates to an entertainment game based principally upon a battle of tanks or equivalent pieces, in which each participant plays with a determined number of tanks, equal for each one, and must undertake to eliminate the rest of his opponents from the board. For purposes of better interpretation of the mechanics of the game, there is taken as an example (non-limiting) the case for two participants with one tank each.

SUMMARY OF THE INVENTION

This invention provides a game apparatus which includes a board laid out in a number of square sections arranged in rows and columns, each section being marked with horizontal, vertical and diagonal bisecting or symmetry lines. Each player manipulates one or more tanks or comparable pieces having rotatable gun turrets or the like in accordance with commands specified on movement cards arranged in a selected sequence by the player at the start of the game, and turned over one at a time. The movement, rotation and firing directions commanded by the cards coincide with the symmetry lines of the board sections.

DETAILED DESCRIPTION OF THE PREFERRED EMBODIMENT

The material elements which comprise the game will first be described.

Figure 1:
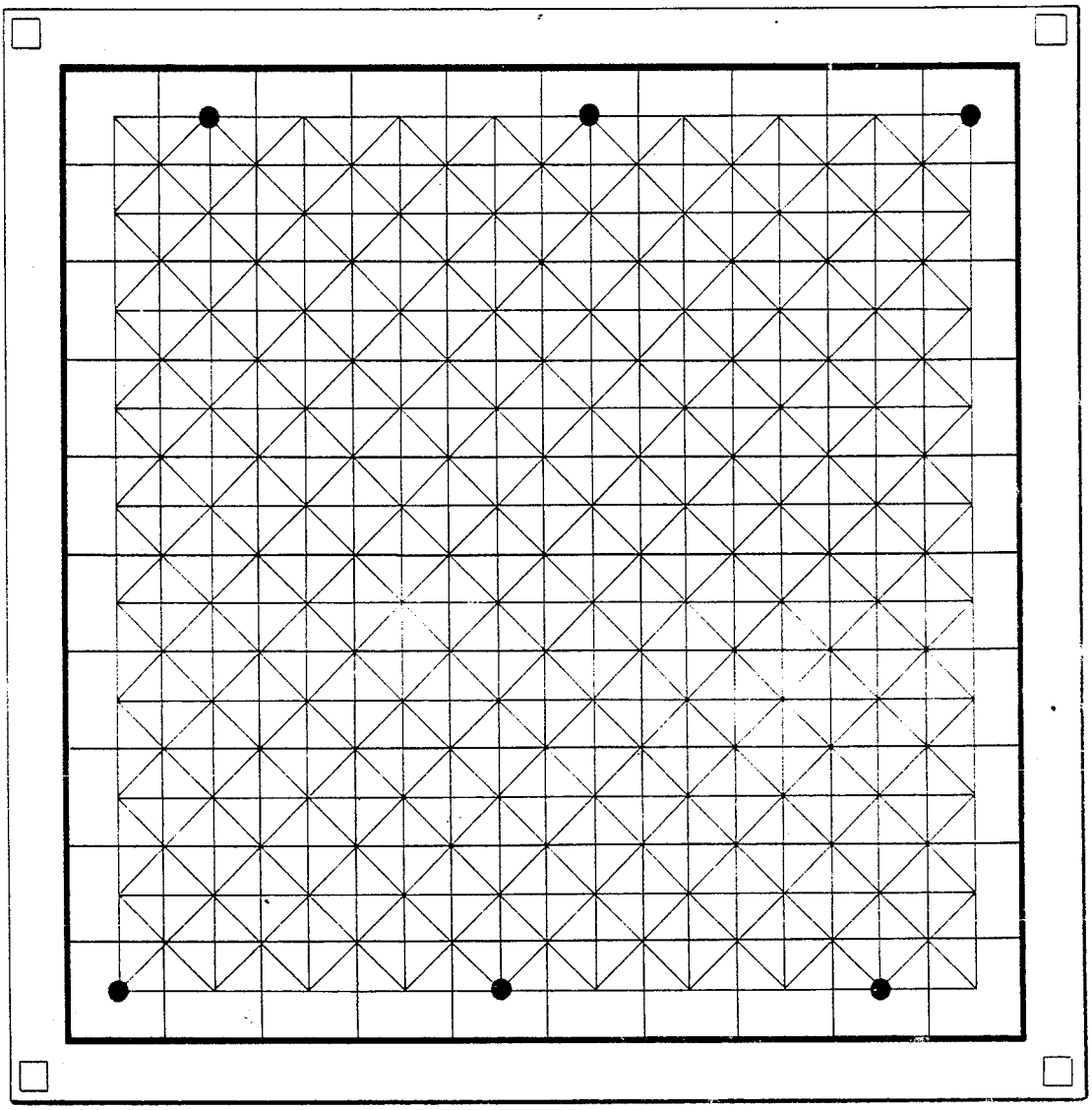
FIG. 1 is a plan view of a game board in accordance with the invention.

Characteristics of the board: The board is square in form, ruled with ten sections to a side, making a total of one hundred sections. A square board having been chosen to present and explain the game does not imply that other varied shapes, also suitable for the development of the game for example octagonal, hexagonal etc. cannot be utilized. The same can be said about the number of sections or any other form which may be adapted for the composition of the board. Within the board the axes of symmetry of each one of the sections and the diagonals are delineated as seen in FIG. 1. In FIG. 1, a complete board can be observed in top view, including six special edge or corner sections differentiated from the rest by a central point in each one of them. These special sections are called "initial sections", due to the tanks being placed in them at the start of the game. These sections will vary in number and location depending on the quantity of tanks and/or participants playing.

Figure 3:
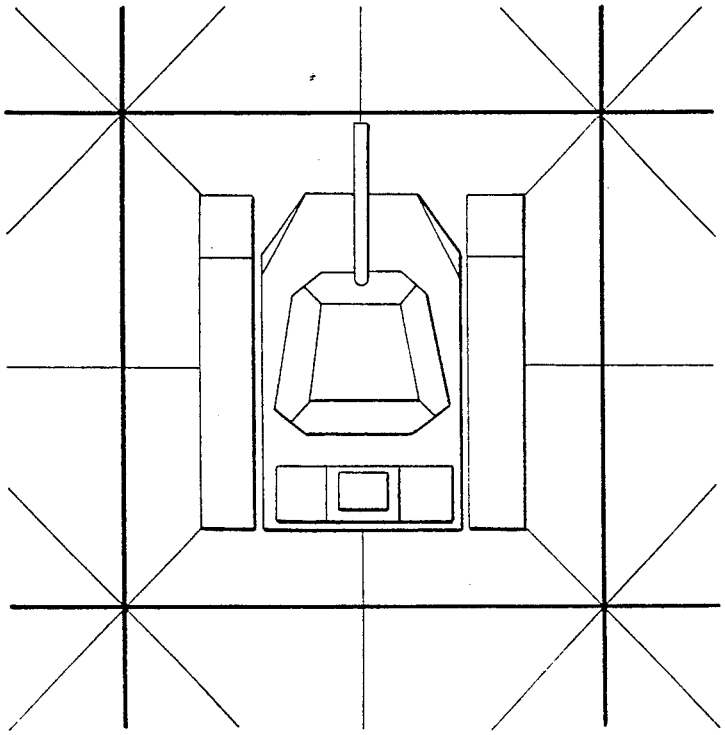
FIGS. 3 and 4 are plan views of a tank placed in a section of the game board, in different orientations.

Characteristics of the tanks: The game pieces resemble miniature tanks, but a war tank or combat vehicle has been selected only for reasons of comfort and esthetics, and the pieces could represent any other object and serve equally well in the playing of the game. The principal characteristic of the piece is that it is composed of two independently mobile elements. The tank adopted is of square shape, with volume or height, and each side and end of the tank is proportional to the sides of the board sections. The two pieces independent of each other in their movement, which compose the tank, are the turret gun and the body of the tank itself. The tanks can be placed inside the sections of the board in only two positions, to wit:

Tank framed in its section: This signifies that the sides of the tank body are parallel to the sides of the section which it occupies (See FIG. 3).

Tank out of phase in its section: The tank is designed such that, when in the "framed" position in a section, on turning the axis of symmetry of its body 45° with respect to any of the section axes of symmetry, the vertices or corners of the tank body coincide with the middle points of the sides of the section that it occupies. As described further on, a tank in this position is capable of moving itself in a diagonal direction over the board. (See FIG. 4).

Explanation of the MOVEMENT CARDS: Each tank possesses for itself a determined quantity of Movement Cards. For the explanation of this particular case, 21 Cards for each tank have been selected. The Card specifies the order or command for the tank, that will be expressed as a movement on the board. The twenty-one orders selected are the following:

(1) TURRET POSITION 1: (2) TURRET POSITION 2; (3) TURRET POSITION 3; (4) TURRET POSITION 4; (5) TURRET POSITION 5; (6) TURRET POSITION 6; (7) TURRET POSITION 7; (8) TURRET POSITION 8; (9) TANK 45° TO THE RIGHT; (10) TANK 45° TO THE LEFT; (11) TANK 90° TO THE RIGHT; (12) TANK 90° TO THE LEFT; (13) INVERT THE POSITION OF THE TANK; (14) ADVANCE THREE; (15) ADVANCE TWO; (16) ADVANCE ONE; (17) RETREAT ONE; (18) RETREAT TWO; (19) PAUSE; (20) FIRE; (21) FIRE.

Figure 2:
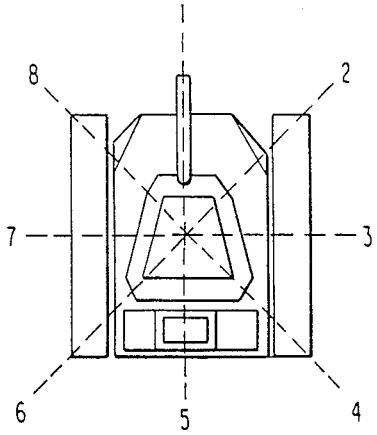
FIG. 2 is a plan view of a playing piece in accordance with the invention.
Figure 4:
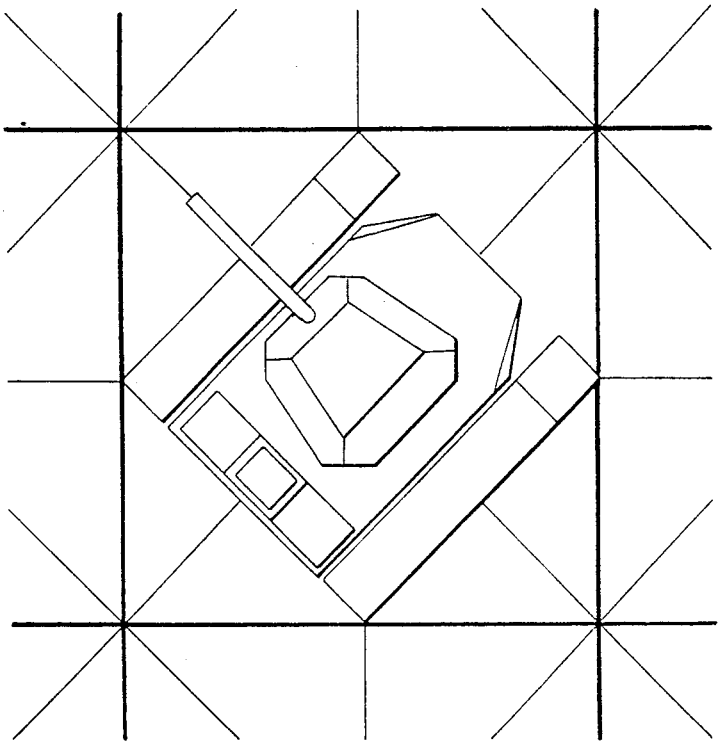

Different positions of the turret gun: Due to the independent movement of the turret gun with respect to the tank body, the gun can adopt eight different positions as designated by the numerals shown in FIG. 2. To keep these positions in mind, FIG. 2 is found in the four corners of the board, represented diagrammatically by four squares in FIG. 1. By way of example, FIG. 4 shows a tank with its turret gun in Position 7. By design, whatever the position selected for the turret gun and whatever the position that the tank occupies in the section, the gun will always coincide either with an axis of symmetry or with some diagonal of the board.

Turn of the tank 45° to the right and 45° to the left: Taking as a point of reference the front part of the tank, it turns 45° to the right when the axis of symmetry or the diagonal of the section it occupies is out of phase, which depends on the position of the tank whether framed or out of phase. The turn of 45° to the left is on the basis of the same mechanism, only to the other side. Therefore, when a tank turns 45° to the right or to the left, if it is framed in its section it goes out of phase, and if it is out of phase it becomes framed.

Turn of the tank 90° to the left: Taking as the point of reference the front part of the tank, it turns 90° to the right when it displaces the axis of symmetry of its body 90° to the right of the axis of symmetry or of the diagonal of the section it occupies, this depending on the position of the tank, either framed or out of phase. The 90° turn to the left is on the basis of the same mechanism, only to the other side. Therefore, when a tank turns 90° to the right or to the left, if it is framed it remains framed, and if it is out of phase it stays out of phase.

To invert the position of the tank: As the term indicates, this movement is independent of the position that the tank occupies in the section, and involves a turn on itself of 180°.

Advance 3 - Advance 2 - Advance 1: Taking as a reference the front part of the tank, this involves advancing the tank forward however many squares the Movement Card played may indicate.

Retreat 2 - Retreat 1: Taking into account which is the rear part of the tank, as the order indicates, the tank must be moved backward however many squares the card may say.

For any advance or retreat, if the tank is framed it will move over the board in a straight line; if it is out of phase it will do so on the diagonal, always taking the square sections as reference.

Figure 5:
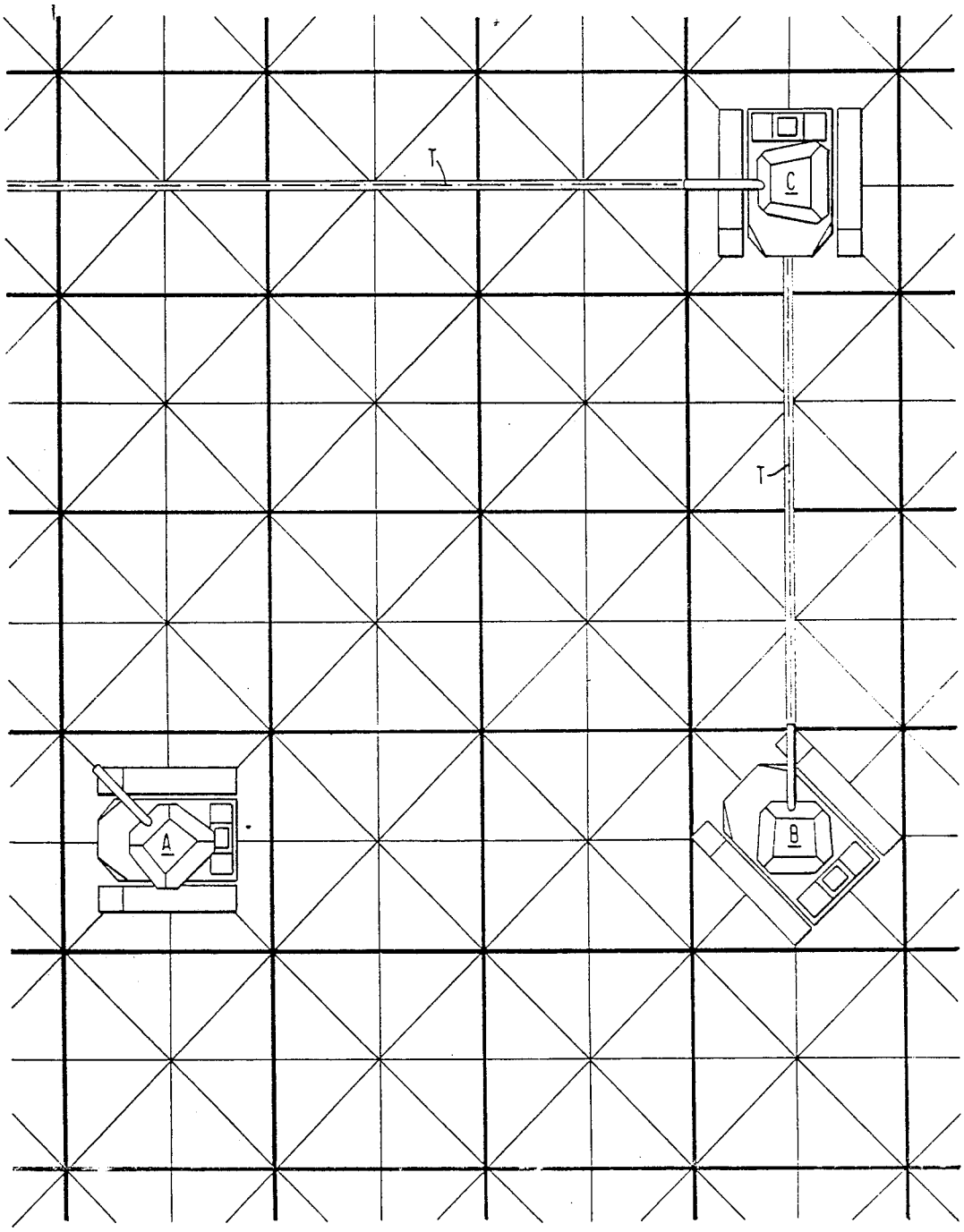
FIG. 5 is a partial plan view of the game board, showing several differently positioned tanks and their gun firing vectors.

Fire: In order to obtain a better understanding of this card, reference is made to the utilization of a vector of fire "T". This vector, as seen in FIG. 5, has as a point of origin the mouth of the gun, as a direction the position of said gun, and as a final point whatever element interrupts that direction, a tank, a defense or the end of the board. The reading or extension of this "T" vector is especially aided by the diagonals and the axes of symmetry of the sections. It has the same significance as an imaginary projectile being fired by the tank's gun. In FIG. 5 the tank "B" is out of phase in the section that it occupies and its turret gun is in Position 2. When a "FIRE" command is executed, its imaginary vector thus runs across the board on the line of an axis of symmetry of the sections, hitting tank "C". Furthermore, when tank "C", framed in its square and with its turret gun in Position 3, carries out a "FIRE" command, its imaginary vector runs across the board on the line of another axis of symmetry, but without hitting any target. One vector may thus run across the board from one end to the other without hitting any target. If tank "B" should wish to fire at tank "A" it should play the Card corresponding to Turret Position 8 or in lieu of that Tank 90° to the Left. Furthermore, if tank "C" should wish to aim at "B" it should play Turret Position 1 or Tank 90° to the Left. If tank "A" wishes to aim at tank "C" it must play Turret Position 4 or else Tank 90° to the Right.

MECHANICS OF THE GAME

Passive part: Each participant prepares a complete game for each one of his tanks, composed of a determined number of Cards, and lays them down outside of the board in order of priority in accordance with his criterion and face down, so as to conceal the direction of movement or command that each of them contains.

Active part: Tank "A" begins the play by uncovering the first of his Cards and performing the order given on the board. Tank "B" follows, carrying this out with his first Card. Successively all the Cards of the game go on being uncovered.

Incidence of the "Fire" action in the development of play: When a tank is hit by a shot, it loses a determined number of Movement Cards corresponding to its initial stack, beginning with the next hand and for the rest of the game. That is the player to which that tank belongs in the next hand and before making the corresponding play, must pick out that number of Cards from the 21 (according to this example) which the affected tank initially possesses and extract them from the pile. The hit tank will thus remain limited in its movements, but the rival will not know in what way. When a tank is hit a second time, utilizing the same mechanics as for the previous case, the player to whom that tank belongs must extract another determined number of Movement Cards from the rest of the pile remaining. Continuing with this mechanism or sequence until the Movement Cards corresponding to the stack for that tank are exhausted, it is withdraWn from the board.

The participant who succeeds in retiring the enemy tank or tanks from the board wins.

We claim:

1. An amusement game apparatus, comprising:

(a) a game board having a planar playing surface defining a plurality of square sections arranged in rows and columns each section being bisected by a horizontal, a vertical and two diagonal direction lines, (b) a plurality of combat playing pieces, each piece having a generally square configuration in plan view with the length of each side and end face being approximately equal to one half the length of a section side times $\sqrt{2}$, and each piece having a simulated projectile turret rotatable about a center of the piece through 360°, and (c) a plurality of movement cards for each playing piece, each movement card bearing indicia specifying manipulation commands for an associated playing piece on the game board.

2. A game apparatus according to claim 1, wherein the playing pieces are tanks and the projectile turrets are gun turrets, and wherein tank movement directions, turret rotation directions and gun firing directions coincide with direction lines on the game board.

3. A game apparatus according to claim 1 wherein the game board is square, and bears directional indicia specifying eight discrete movement directions spaced 45° apart.

* * * * *